US011838998B2

(12) United States Patent
Narita et al.

(10) Patent No.: US 11,838,998 B2
(45) Date of Patent: Dec. 5, 2023

(54) MULTI-SHANK HEATER

(71) Applicant: JX Nippon Mining & Metals Corporation, Tokyo (JP)

(72) Inventors: Satoyasu Narita, Ibaraki (JP); Hiroshi Takamura, Ibaraki (JP)

(73) Assignee: JX Metals Corporation, Tokyo (JP)

( * ) Notice: Subject to any disclaimer, the term of this patent is extended or adjusted under 35 U.S.C. 154(b) by 641 days.

(21) Appl. No.: 17/051,346

(22) PCT Filed: Oct. 29, 2019

(86) PCT No.: PCT/JP2019/042260
§ 371 (c)(1),
(2) Date: Oct. 28, 2020

(87) PCT Pub. No.: WO2020/202619
PCT Pub. Date: Oct. 8, 2020

(65) Prior Publication Data

US 2021/0068206 A1 Mar. 4, 2021

(30) Foreign Application Priority Data

Mar. 29, 2019 (JP) ..... 2019-068322

(51) Int. Cl.
*H05B 3/64* (2006.01)
*H05B 3/12* (2006.01)

(52) U.S. Cl.
CPC ..... *H05B 3/64* (2013.01); *H05B 3/12* (2013.01)

(58) Field of Classification Search
CPC ..... H05B 2203/003; H05B 2203/018; H05B 3/12; H05B 3/148; H05B 3/64; H05B 3/06; A61F 13/15585; A61F 13/49; A61F 13/49011; A61F 13/49012; A61F 13/496; A61F 13/51; A61F 13/51474; A61F 13/515; A61F 2013/15878; A61F 2013/1591; A61K 2039/5156; A61K 2039/5158; A61K 2039/86; A61K 39/0011; A61P 35/00; C07K 14/4748; C07K 14/7051;
(Continued)

(56) References Cited

U.S. PATENT DOCUMENTS 4,016,403 A 4/1977 Best
6,844,532 B2 * 1/2005 Takamura ..... H05B 3/143 219/56
10,251,217 B2 4/2019 Gotoh

FOREIGN PATENT DOCUMENTS

GB 1509102 4/1978
JP S63-082932 U 5/1988
(Continued)

*Primary Examiner* — Quang T Van
(74) *Attorney, Agent, or Firm* — HOWSON & HOWSON LLP

(57) ABSTRACT

Provided is a multi-shank heater to be mounted on a support substrate, wherein, with a normal direction relative to the support substrate, which is a direction from the heater side toward the support substrate side, as a basis, the multi-shank heater has U-shaped pieces in which an angle θ of a planar direction of the U-shaped pieces, which is a direction from the heater side toward the support substrate side, is ±10° or more and ±60° or less. An object of the present invention is to provide a multi-shank heater capable of considerably improving the energy output even when the U-shaped pieces are arranged in a high density and have the same pitch.

8 Claims, 7 Drawing Sheets

(58) Field of Classification Search
CPC ..... C07K 16/30; C07K 2317/32; C07K 2319/03; H04B 7/024; H04B 7/2675; H04L 27/2657; H04W 84/12
USPC ..... 373/134, 117, 132, 133; 219/548, 538, 219/522, 553, 390, 56, 58
See application file for complete search history.

(56) References Cited

FOREIGN PATENT DOCUMENTS

| | | | | |
|---|---|---|---|---|
| JP | H07-018447 | A | | 1/1995 |
| JP | 08143365 | A | * | 6/1996 |
| JP | 2000-252047 | A | | 9/2000 |
| JP | 4539895 | B2 | * | 9/2010 |

* cited by examiner

MULTI-SHANK HEATER

BACKGROUND

The present invention relates to a multi-shank heater.

Since a heater having molybdenum disilicide ($MoSi_2$) as its main component exhibits superior oxidation resistance, it has been used from long ago as an ultra high-temperature heater for use in the air atmosphere or oxidizing atmosphere, and is still currently being used in a wide range of applications. This kind of molybdenum disilicide heater contains 70 wt % or more of $MoSi_2$ as its main component, and there are cases when an insulating oxide such as $SiO_2$ is added thereto in order to increase the electrical resistance.

Today, heaters having molybdenum disilicide as its main component which are used in numerous fields such as the glass industry and the baking of ceramics are known as multi-shank type in which a cylindrical rod-shaped $MoSi_2$ material is softened under a high temperature and bent and processed into a shape which forms one U-shape (2 shank-type), and these U-shapes are welded and connected so that they alternately face opposite directions. This type of multi-shank heater is used by being mounted on a support substrate such as the ceiling or the side wall of a furnace.

Today, the standard of commercially available multi-shank heaters is as follows; specifically, the wire diameters of the heat-generating part and the terminal part are respectively φ3 mm/φ6 mm, φ4 mm/φ9 mm, φ6 mm/φ12 mm, φ9 mm/φ18 mm, φ12 mm/φ24 mm, and so on. When the heater is energized, the high-resistant part having a small diameter becomes a high temperature and functions as the heat-generating part, and the low-resistant part having a large diameter suppresses the generation of heat and functions as the terminal part for maintaining the power feeding section at a low temperature.

In connection with this kind of multi-shank heater, since the space between the respective zones becomes a dead space (area where the temperature will not rise) in a multi-zone multi-shank heater, Patent Document 1 discloses arranging the folded parts so that they engage with each other between the zones as a method of resolving the foregoing problem. Moreover, Patent Document 2 describes forming a heater as a U-shaped heater or a W-shaped heater since a multi-shank heater has a problem in performing fine temperature control.

CITATION LIST

Patent Documents

[Patent Document 1] Japanese Unexamined Patent Application Publication No. H7-18447

[Patent Document 2] Japanese Unexamined Patent Application Publication No. 2000-252047

SUMMARY

In order to increase the energy output of a multi-shank heater, while it may be possible to narrow down the interval (pitch) of the U-shapes, the pitch has a lower limit, and this is dependent on the diameter of the U-shaped pieces. If the U-shaped pieces are bent in a pitch that is narrower than the lower limit, cracks may occur in the bent part of the U-shapes, and cause the breaking of wires during the bending work. This kind of pitch restriction is also a restriction of the energy output in a multi-shank heater.

Moreover, while it may also be possible to increase the current applied to the heater in order to increase the output, excessive current will reduce the life expectancy of the heater, and this kind of act is not advisable particularly with a $MoSi_2$ multi-shank heater in which the price of the heater itself is expensive, and the replacement thereof is complicated and time-consuming. Accordingly, with a conventional multi-shank heater, there is a problem in that, once the installation space of the heater (surface area inside the furnace) is decided, the upper limit of the output is also inevitably decided.

Thus, the present invention was devised in order to resolve the foregoing problems encountered with a conventional multi-shank $MoSi_2$ heater, and an object of this invention is to provide a multi-shank heater capable of considerably improving the energy output even when the U-shaped pieces are arranged in a high density and have the same pitch.

The present invention was devised for achieving the foregoing object, and a multi-shank heater according to an embodiment of the present invention is characterized in that, with a normal direction relative to the support substrate, which is a direction from the heater side toward the support substrate side, as a basis, the multi-shank heater has U-shaped pieces in which an angle θ of a planar direction of the U-shaped pieces, which is a direction from the heater side toward the support substrate side, is ±10° or more and ±60° or less.

According to the present invention, since the respective U-shaped pieces can be arranged in a high density, superior effects are yielded in that the total length of the heat-generating part can be extended, and the energy output per unit installation area can be considerably improved.

DETAILED DESCRIPTION

A multi-shank heater is normally manufactured in the following manner. Foremost, a $MoSi_2$ powder and the like as the heater raw material is mixed with a binder, and this mixture is formed into a round rod shape with an extruding machine and so on. Next, after performing drying, degreasing and then primary sintering, electric current sintering is performed to prepare a rod material having a predetermined diameter. Thereafter, the rod material is set in a U-shape bending machine, the rod material is bent into a U-shape at a predetermined pitch while being energized and heated, and a U-shaped round rod material (this is hereinafter referred to as a "U-shaped piece") is thereby manufactured. Since the thus prepared U-shaped piece is bent into a U-shape on the same plane, the two parallel straight parts and the bent part configuring the U-shape form one plane (this is hereinafter sometimes referred to as the "U-shaped piece plane"). A plurality of the thus prepared U-shaped pieces are respectively welded alternately in an upward U-shape and a downward U-shape to form a multi-shank heater.

Figure 1:
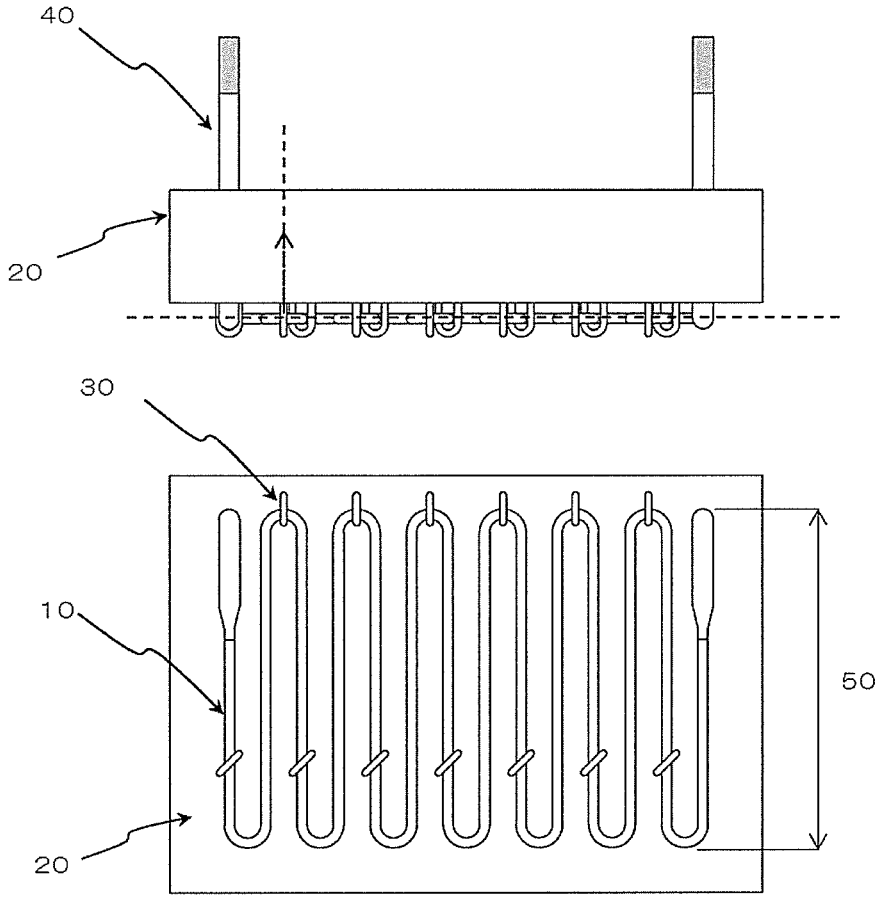
FIG. 1 is a cross section of a conventional multi-shank heater (upper diagram is a top view, and lower diagram is a front view).

A schematic diagram of a conventional multi-shank heater mounted on a support substrate is shown in FIG. 1. A heater 10 formed by connecting the respective U-shaped pieces is mounted on a support substrate (including the heat insulating material) 20 with a fixing pin 30. The terminal part of the heater penetrates the furnace wall and is connected to the power source via an external terminal 40. Conventionally, as shown in the upper diagram of FIG. 1, while each and every one of the U-shaped piece planes were connected in a linear array in parallel relative to the support substrate so as to form the same surface (plane), there were restrictions in the number of U-shaped pieces (heaters) that can be installed when the U-shaped pieces are arranged two-dimensionally as described above. Note that, as shown in FIG. 2 of Patent Document 1, even when the support substrate is of a cylindrical shape, while the welding of each of the U-shaped pieces is angled, each and every one of the U-shaped piece planes are arranged in parallel relative to the support substrate, and disposed so that they substantially form the same surface (curved surface).

Figure 2:
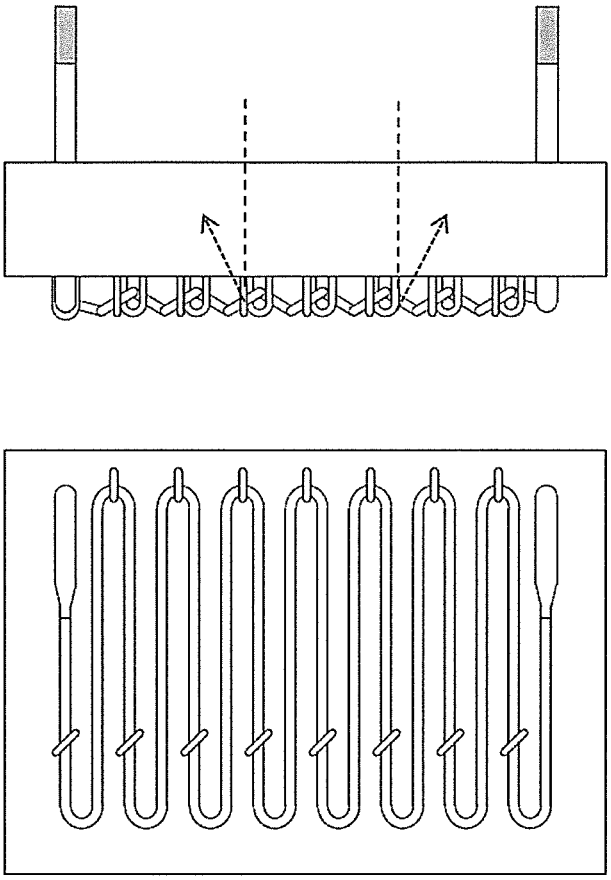
FIG. 2 is a cross section of the multi-shank heater according to an embodiment of the present invention (upper diagram is a top view, and lower diagram is a front view).

In order to overcome the foregoing problem, with the multi-shank heater according to an embodiment of the present invention, as shown in the upper diagram of FIG. 2, the respective U-shaped piece planes are connected by being angled relative to the support substrate. As a result of adopting this kind of structure, for example, with a multi-shank heater having the shape as shown in the lower diagram of FIG. 2, the number of U-shapes has increased from 13 U-shapes to 15 U-shapes in comparison to the foregoing conventional multi-shank heater, the total length of the heater heat-generating part (U-shaped pieces) has increased, and the energy output can thereby be increased considerably.

Figure 3:
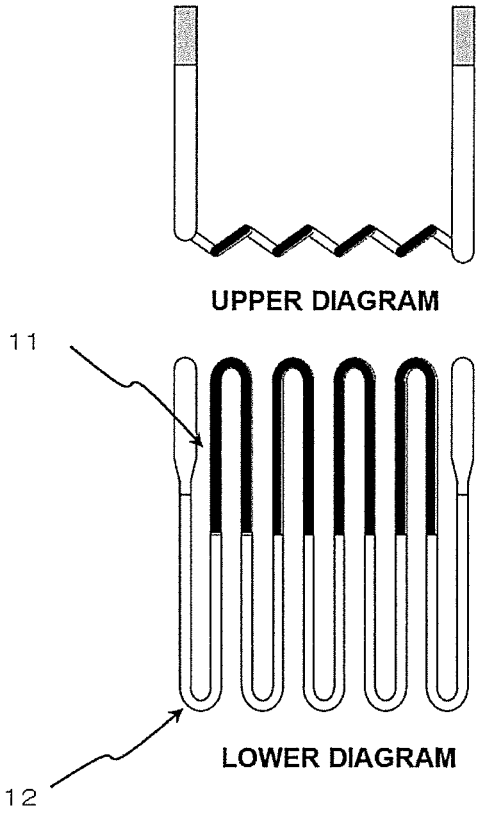
FIG. 3 is an explanatory diagram of the heater heat-generating part in the multi-shank heater according to an embodiment of the present invention (upper diagram is a top view, and lower diagram is a front view).

FIG. 3 is an explanatory diagram of the heater heat-generating part in the multi-shank heater according to an embodiment of the present invention, wherein the upper diagram of FIG. 3 is a top view of the multi-shank heater, and the lower diagram of FIG. 3 is a front view of the multi-shank heater. As shown in FIG. 3, the multi-shank heater is configured by a U-shaped piece 11 having an upward U-shape (shown in black color) and a U-shaped piece having a downward U-shape (shown in white color) being alternately welded and connected. Moreover, FIG. 4 is an extract of a part of the heater heat-generating part of FIG. 3 (three U-shaped pieces that are connected), and a support substrate has been added for the sake of convenience in providing the explanation.

Figure 4:
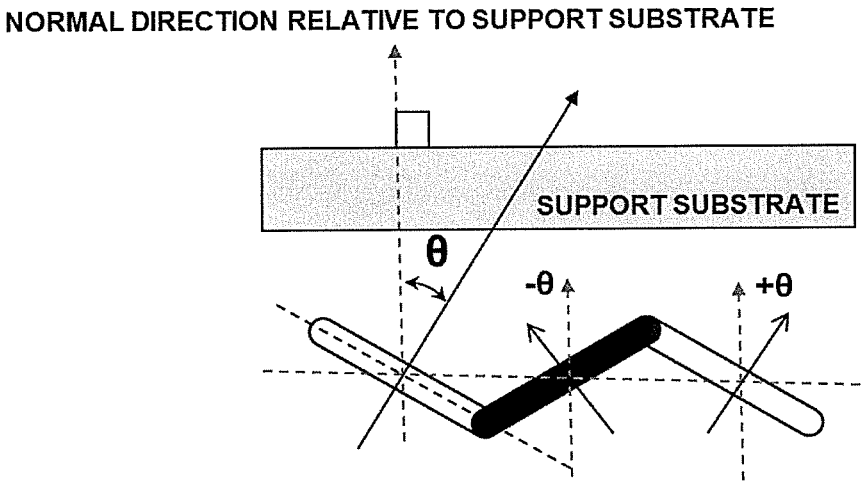
FIG. 4 is an enlarged view of a part of the multi-shank heater according to an embodiment of the present invention (top view).

The multi-shank heater of this embodiment is characterized in that, as shown in FIG. 4, with a normal direction relative to the support substrate (direction from the heater side toward the support substrate side) as a basis, the multi-shank heater has U-shaped pieces in which a planar direction of the U-shaped pieces (direction from the heater side toward the support substrate side) has an angle ±θ. Here, +θ means that, as shown in FIG. 4, the U-shaped pieces were rotated clockwise at an angle θ in a planar direction of the U-shaped pieces (direction of arrow: direction from the heater side toward the support substrate side) with the normal direction relative to the support substrate (direction of arrow: direction from the heater side toward the support substrate side) as the basis. Meanwhile, −θ means that, as shown in FIG. 4, the U-shaped pieces were rotated counterclockwise at an angle θ in a planar direction of the U-shaped pieces (direction of arrow: direction from the heater side toward the support substrate side) with the normal direction relative to the support substrate (direction of arrow: direction from the heater side toward the support substrate side) as the basis. Note that, with a conventional multi-shank heater, all U-shaped piece planes have the foregoing angle θ=0°.

With the multi-shank heater according to an embodiment of the present invention, preferably, with a normal direction relative to the support substrate, which is a direction from the heater side toward the support substrate side, as a basis, the angle θ of the planar direction of the U-shaped pieces, which is a direction from the heater side toward the support substrate side, is ±10° or more and ±60° or less. When the angle θ is less than ±10°, the high densification of the U-shaped pieces will be insufficient. Meanwhile, when the angle θ exceeds ±60°, since the heater will protrude considerably toward the work side (member to be heated), this is not practical, and it also becomes difficult to mount the U-shaped pieces. More preferably, the angle θ is ±45° or less. Note that, since the U-shaped pieces in which the angle θ is ±10° or more and ±60° or less may be arranged in such a manner in all or a part of the multi-shank heater, for instance, the U-shaped pieces may have the angle θ=0° in a part of the multi-shank heater.

Moreover, in an embodiment of the present invention, preferably, among the U-shaped pieces configuring the multi-shank heater, a U-shaped piece in which the angle θ is ±10° or more and ±60° or less exists at three or more locations. When a U-shaped piece exists at least at three or more locations, improvement in the energy output based on the high densification of the U-shaped pieces can be expected. Furthermore, in order to efficiently increase the number of U shapes per unit area of the multi-shank heater, in an embodiment of the present invention, preferably, a U-shaped piece in which the angle θ is +10° or more and +60° or less and a U-shaped piece in which the angle θ is −10° or more and −60° or less respectively exist at least at one or more locations. In addition, preferably, a U-shaped piece in which the angle θ is +10° or more and +60° or less and a U-shaped piece in which the angle θ is −10° or more and −60° or less are connected adjacent to each other, and such connected U-shaped pieces exist in a plurality.

The multi-shank heater according to an embodiment of the present invention is mounted on a support substrate such as the ceiling or furnace wall inside the heating furnace or any other separately provided board, and a heat insulating material is disposed between the support substrate and the heater. The support substrate is formed from a refractory brick, a heat insulating brick, a ceramic fiber board, a micro porous board or the like, and the present invention can be applied irrespective of whether its shape is a flat shape, a slope (slide) shape, a curved shape, a cylindrical shape or the like. Moreover, as the heat insulating material, a high-temperature heat insulating material having a thermal conductivity of 0.6 W/mK or less at a temperature of 800° C. is preferably used.

While the multi-shank heater according to this embodiment has molybdenum disilicide ($MoSi_2$) as its main component, the present invention can also be applied to multi-shank heaters formed from other material components.

EXAMPLES

The present invention is now explained based on the following Examples and Comparative Examples. These Examples are illustrative only, and the present invention is not limited in any way based on the Examples. In other words, the present invention is limited only by the scope of its claims, and covers the various modifications other than the Examples included in the present invention.

Conventional Example

A cross section of a conventional multi-shank heater is shown in FIG. 1. This is a multi-shank heater in which the respective U-shaped pieces (wire diameter: φ4 mm, pitch: 16 mm, shank height: 150 mm) were welded without forming any angle (θ=0°) and formed in a linear array. The multi-shank heater was mounted on a support substrate 20 with a fixing pin 30, and a terminal 40 was thereafter welded. Here, when a multi-shank heater having a horizontal width of 208 mm is to be mounted on a support substrate having a horizontal width of 280 mm, the upper limit of the number of U-shapes is 13 U-shapes, and the expanded length (total length) of the heat-generating part is 2051 mm.

Example 1

A cross section of the multi-shank heater of Example 1 is shown in FIG. 2. As with the conventional example, in order to mount a multi-shank heater having a horizontal width of 208 mm on a support substrate having a horizontal width of 280 mm, the respective U-shaped pieces (wire diameter: φ4 mm, pitch: 16 mm, shank height: 150 mm) were welded by being slanted so that the angle θ=±31.62°. However, only the downward U-shapes on either end of the heater were welded by changing the angle to θ=±15.20°. In the foregoing case, the number of U-shapes was 15 U-shapes, and the expanded length (total length) of the heat-generating part was 2355 mm. Since the output of the heater is proportional to the total length of the heat-generating part, an output improvement of roughly 15% in comparison to the reference example can be expected.

Example 2

Figure 5:
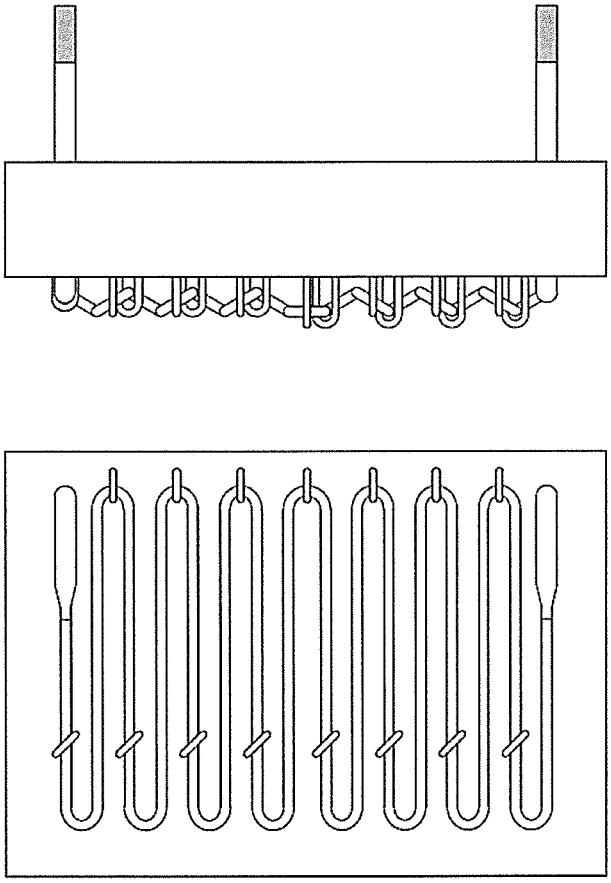
FIG. 5 is a cross section of the multi-shank heater of Example 2 (upper diagram is a top view, and lower diagram is a front view).

A cross section of the multi-shank heater of Example 2 is shown in FIG. 5. As with the conventional example, in order to mount a multi-shank heater having a horizontal width of 208 mm on a support substrate having a horizontal width of 280 mm, the respective U-shaped pieces (wire diameter: φ4 mm, pitch: 16 mm) were slanted so that the angle θ=±31°, and a part arranged horizontally without forming any angle (θ=0°) was provided at one part at the center and welded. In the foregoing case, as with Example 1, the number of U-shapes was 15 U-shapes, the expanded length (total length) of the heat-generating part was 2355 mm, and an output improvement of roughly 15% in comparison to the conventional example can be expected.

Example 3

Figure 6:
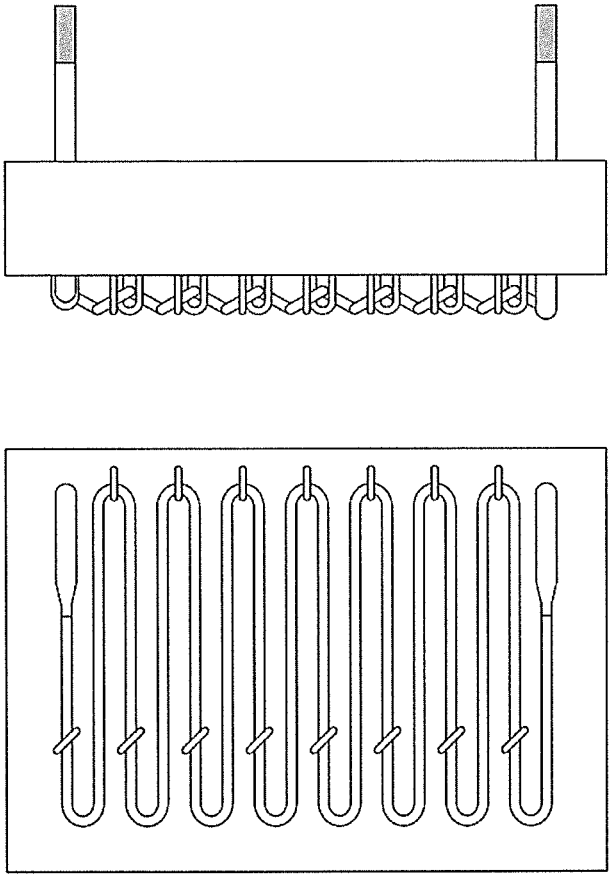
FIG. 6 is a cross section of the multi-shank heater of Example 3 (upper diagram is a top view, and lower diagram is a front view).
Figure 7:
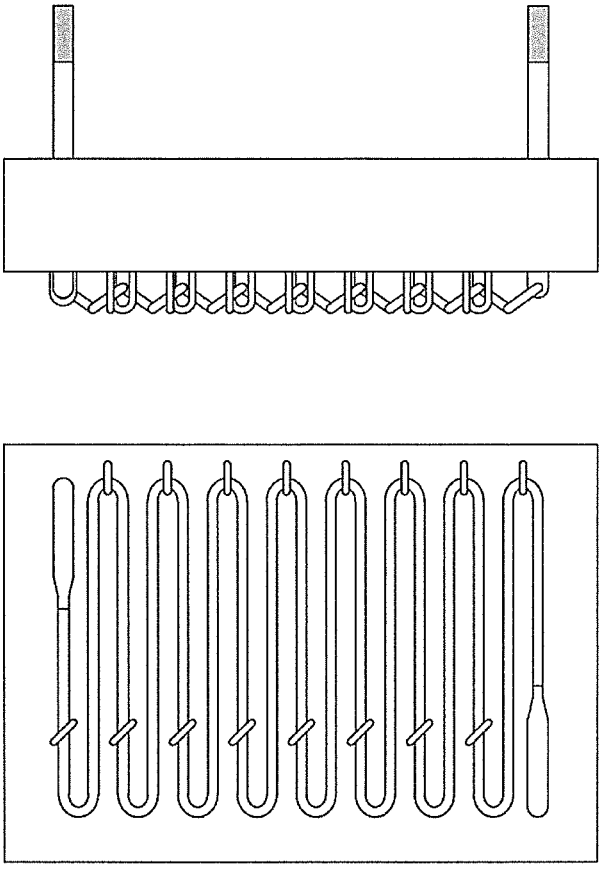
FIG. 7 is a cross section of the multi-shank heater of Example 4 (upper diagram is a top view, and lower diagram is a front view).

A cross section of the multi-shank heater of Example 3 is shown in FIG. 6. As with the conventional example, in order to mount a multi-shank heater having a horizontal width of 208 mm on a support substrate having a horizontal width of 280 mm, the respective U-shaped pieces (wire diameter: φ4 mm, pitch: 16 mm, shank height: 150 mm) were welded by being slanted so that the angle θ=±29.93°. In the foregoing case, as with Example 1, the number of U-shapes was 15 U-shapes, the expanded length (total length) of the heat-generating part was 2355 mm, and an output improvement of roughly 15% in comparison to the conventional example can be expected. Note that, since the right-side terminal part will protrude farther than the left-side terminal part as shown in the upper diagram of FIG. 6, it is necessary to prepare terminals having a different length on the left side and the right side.

Example 4

A cross section of the multi-shank heater of Example 4 is shown in FIG. 2. As with the conventional example, in order to mount a multi-shank heater having a horizontal width of 208 mm on a support substrate having a horizontal width of 280 mm, the respective U-shaped pieces (wire diameter: φ4 mm, pitch: 16 mm, shank height: 150 mm) were welded by being slanted so that the angle θ=±35.66°. In the foregoing case, the number of U-shapes was 16 U-shapes, the expanded length (total length) of the heat-generating part was 2516 mm, and an output improvement of roughly 22.7% in comparison to the conventional example can be expected. Note that, since the right-side terminal part will face upward, it may come into contact with the heat insulating material in certain cases, but other means for avoiding such contact may be adopted as needed.

According to the present invention, since the respective U-shaped pieces (heat-generating part) in a multi-shank heater can be arranged in a high density, superior effects are yielded in that the total length of the heat-generating part can be extended, and the energy output can be considerably improved. The multi-shank heater according to the present invention is useful as a baking heater of glass and ceramics.

DESCRIPTION OF REFERENCE NUMERALS

10 heater heat-generating part
11 U-shaped piece (upward U shape: shown in black color)
12 U-shaped piece (downward U shape: shown in white color)
20 support substrate
30 fixing pin
40 terminal
50 shank height

The invention claimed is:

1. A multi-shank heater to be mounted on a support substrate, wherein, with a normal direction relative to the support substrate, which is a direction from a heater side toward a support substrate side, as a basis, the multi-shank heater has U-shaped pieces in which an angle θ of a planar direction of the U-shaped pieces, which is a direction from the heater side toward the support substrate side, is +10° or more and ±60° or less, and a U-shaped piece in which the angle θ is +10° or more and +60° or less and a U-shaped piece in which the angle θ is −10° or more and −60° or less respectively exist at least at one or more locations.

2. The multi-shank heater according to claim 1, wherein, among the U-shaped pieces configuring the heater, a U-shaped piece in which the angle is ±10° or more and ±60° or less exists at three or more locations.

3. The multi-shank heater according to claim 2, wherein the U-shaped piece in which the angle θ is +10° or more and +60° or less and the U-shaped piece in which the angle θ is −10° or more and −60° or less are connected adjacent to each other, and such connected U-shaped pieces exist in a plurality.

4. The multi-shank heater according to claim 3, wherein the support substrate is of a planar shape, a polyhedral shape, a slope (slide) shape, a curved shape or a cylindrical shape.

5. The multi-shank heater according to claim 4, wherein the heater has $MoSi_2$ as its main component.

6. The multi-shank heater according to claim 1, wherein the U-shaped piece in which the angle θ is +10° or more and +60° or less and the U-shaped piece in which the angle θ is −10° or more and −60° or less are connected adjacent to each other, and such connected U-shaped pieces exist in a plurality.

7. The multi-shank heater according to claim 1, wherein the support substrate is of a planar shape, a polyhedral shape, a slope (slide) shape, a curved shape or a cylindrical shape.

8. The multi-shank heater according to claim 1, wherein the heater has $MoSi_2$ as its main component.

* * * * *